PARTITION WIREWAY WITH FLEXIBLE SIDES

BACKGROUND OF THE INVENTION

The present invention relates to movable room divider panels or partitions, and in particular to a wireway therefor.

Heretofore, partitions have been provided with wiring raceways which extend along the base of the partition panel. These partition wireways are designed to house both power wires, such as 110 VAC lines, for lighting, typewriters, and other office appliances, as well as communication lines and other casual wiring. A removable cover is provided to access the wireway, and the electrical cables are generally retained in a separate rigid enclosure within the wireway to positively segregate the power cables from the other wires.

The above partition wireway arrangements provide limited storage space for communication cables and other casual wiring. Also, such partitions are difficult to wire and cannot be easily modified to accept additional casual wires, as the covers of the panel wireways must be removed and replaced to accomplish insertion or withdrawal of wiring from the raceway. The removal and replacement of the wireway covers is especially difficult and time consuming when furniture and other heavy objects have been placed directly in front of the covers, as is normally the case in partitioned areas.

SUMMARY OF THE INVENTION

One aspect of the present invention is to provide a partition wireway for communication cables and the like, comprising a U-shaped channel connected with the partition and extending along and beneath the base of the panel. The U-shaped channel includes a rigid web for supporting the cables thereon, and a pair of upstanding flanges with free edges disposed adjacent the bottom of the partition base to substantially enclose the raceway. At least one of the flanges is resiliently flexible, with sufficient stiffness to normally maintain the U-shape of the channel and thereby retain and conceal the cables therein and sufficient flexability to permit localized, manual, elastic deformation along the flange free edge for inserting and withdrawing the cables from the raceway. The channel preferably includes at least two spacers connected to the channel at the centerline of the channel web, with an upper end thereof attached to a support to suspend the raceway therefrom.

The principal objects of the present invention are to provide additional storage space under the base of the partition for communication cables and other casual wiring. At least one of the wireway sides is flexible so that the wires can be easily inserted and withdrawn from the raceway, without removing or replacing a raceway cover. The flexible side of the partition wireway permits an installer to quickly and easily arrange casual wiring in the raceways, even when furniture, or other large objects are positioned immediately adjacent the partitions. The partition wireway is quite efficient in use, economical to manufacture, capable of a long operating life, and particularly well adapted for the proposed use.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
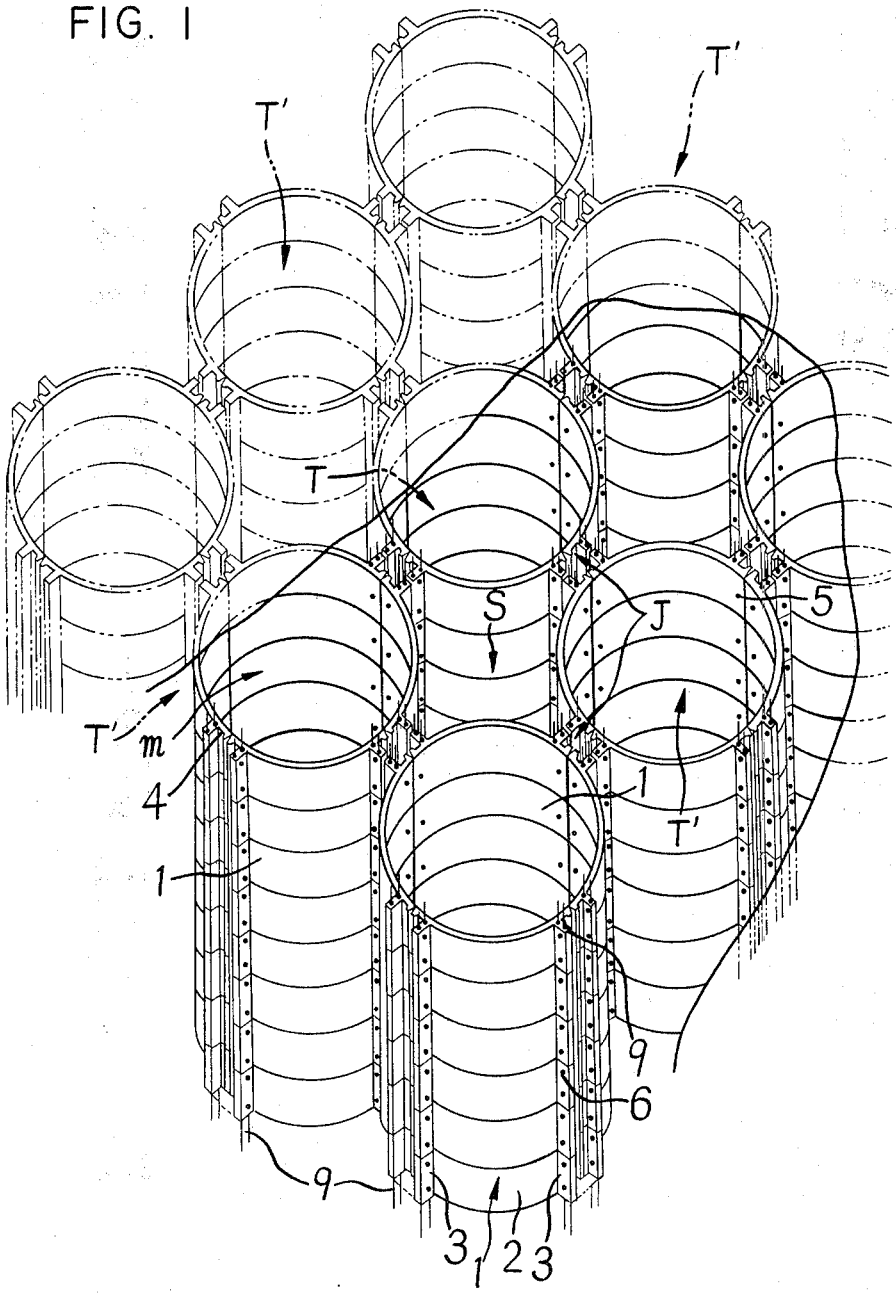
FIG. 1 is a fragmentary, front elevational view of three interconnected partitions, each having a wireway embodying the present invention, and being shown with a communication cable being inserted into the center partition wireway.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 generally designates a partition having a wiring raceway 2 for communication cables, and the like, which embodies the present invention. Raceway 2 comprises a U-shaped channel 3 (FIG. 2) connected with partition 1 and extending along and beneath the base 4 of the partition. Channel 3 has a rigid web 5 for supporting cable 6 and a pair of upstanding flanges 7 with free edges 8 disposed adjacent the partition base to enclose the raceway. At least one of the flanges 7 is resiliently flexible to permit localized, elastic deformation of the flange for inserting and withdrawing the cable 6 from the raceway.

As best illustrated in FIG. 1, each of the partitions 1 is a movable room divider having a conventional construction. In this example, the partitions 1 include a divider panel 11 having the bottom edge 12 with an electrical power wireway 13 mounted thereunder. A pair of adjustable feet 14 are attached to the panel lower edge 12 adjacent each end thereof and are adapted to abut the floor or ground and support the partition thereon in an upright orientation.

Raceway 2 is suspended from the base 4 of partition 1 along the centerline of the channel web 5, thereby forming two separate receptacles for the communication cable 6, and permitting insertion and withdrawal of the cables from both sides of the raceway. Raceway 2 comprises first and second elongate, rigid sheet metal channels 50 and 51, which are shaped to fit into one another to form the rigid web portion 5 of channel 3. A sheet 52 of resilient material has a center portion thereof sandwiched between channels 50 and 51, with side edge portions 53 extending from inbetween the upturned edges 54 of the channels to form the flanges 7 of channel 3. The flexibility or durometer of sheet 52 is substantially constant throughout the same. Fasteners 55 (FIG. 4) extend through the web of the channels 50 and 51, as well as sheet 52, to retain the assembly together. Channel 3 is suspended from the base 56 of power wireway 57 by sleeve-shaped spacers 58 through which fasteners 59 are received. Apertures 60 are provided through the channels 50–51 and flexible sheet 52 at the ends of raceway 2 through which partition feet 14 extend. Electrical

United States Patent [19]

Kato et al.

[11] 4,406,102

[45] Sep. 27, 1983

[54] PRECAST CONCRETE SILO COMPLEX AND A METHOD OF CONSTRUCTING IT

[75] Inventors: Kunio Kato, Yokohama; Yoshihide Tamura, Chiba, both of Japan

[73] Assignee: Taisei Kensetsu Kabushiki Kaisha, Tokyo, Japan

[21] Appl. No.: 214,689

[22] Filed: Dec. 9, 1980

[30] Foreign Application Priority Data

Dec. 13, 1979 [JP] Japan ..... 54-161918

[51] Int. Cl.[3] ..... E04C 3/20

[52] U.S. Cl. ..... 52/224; 52/584

[58] Field of Search ..... 52/224, 583, 584, 235, 52/726, 745, 747

[56] References Cited

U.S. PATENT DOCUMENTS

| | | | |
|---|---|---|---|
| 2,808,624 | 10/1957 | Sullivan | 52/584 X |
| 3,289,366 | 12/1966 | Abrams | 52/224 X |
| 3,853,277 | 12/1974 | Bush | 52/224 X |
| 4,232,495 | 11/1980 | Lin et al. | 52/224 |

*Primary Examiner*—J. Karl Bell

*Attorney, Agent, or Firm*—Wenderoth, Lind & Ponack

[57] ABSTRACT

A precast concrete silo complex and a method of constructing it, in which quarter-cylindrical precast concrete members, constituting unit members, are each provided with a pair of radially protruding couplings near both the ends of the member, and the unit members are arranged to form unit cylinders. The unit cylinders are arranged lengthwise and crosswise, with the couplings facing the couplings of adjacent unit cylinders for defining a coupling space between each two adjacent unit cylinders. Horizontal clamp rods extend through the coupling spaces between the end portions of the unit members and between the couplings, and concrete is provided in the coupling spaces. The horizontal clamp rods are tensioned to clamp the end portions of the unit members and the couplings, to give prestress to the concrete, thereby combining the adjacent unit cylinders and solidifying the unit cylinders arranged lengthwise and crosswise. The unit members are joined vertically by mortar, and vertical clamp rods extend vertically set the unit members and are prestressed to apply prestress to the assembled unit cylinders, solidifying the complex vertically. Thus silo cylinders having a desired height are provided which are solidified lengthwise and crosswise, and which the inside of the silo cylinders constitute the main silo spaces and the spaces formed among the adjacent silo cylinders constitute sub silo spaces.

11 Claims, 16 Drawing Figures

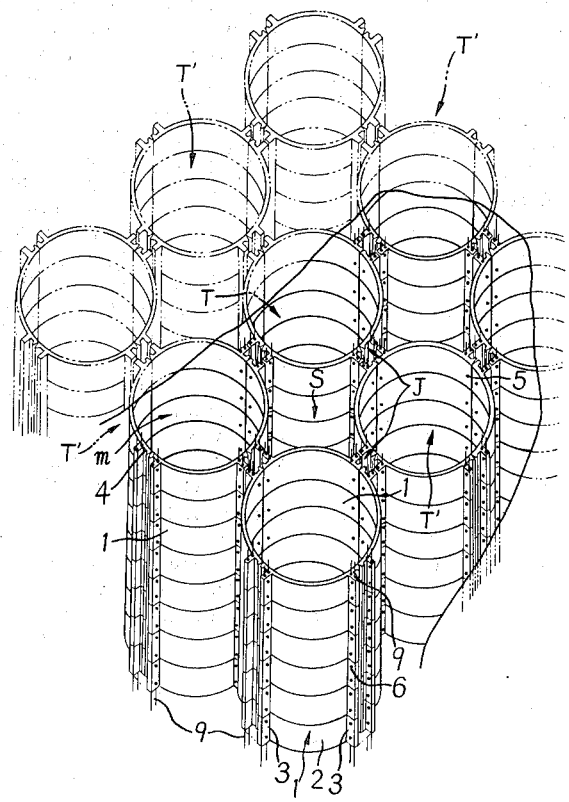

PRECAST CONCRETE SILO COMPLEX AND A METHOD OF CONSTRUCTING IT

BACKGROUND OF THE INVENTION

The present invention relates to a precast concrete silo complex and a method of constructing it. Recently, high quality voluminous silos have been required for storing cereal grains, various raw materials, fodder, etc, and especially silos for grains are required to be highly airtight and structurally safe. As a method of constructing such silos, conventionally, the sliding form method has been considered the best. With the sliding form method, about 1.2 m high inside and outside molds are fixed by a frame called a yoke, and while said molds are raised upward at about 30 cm per hour by a hydraulic jack fitted to said yoke, concrete is poured continuously. In other words, concrete placing and mold releasing occur simultaneously so that a monolithic silo cylinder is produced. This method, compared with the successive concrete placing method makes it possible to obtain high airtightness which is the most important for grains (especially for imported grains) and provides a beautiful appearance, and therefore has been considered the best method as mentioned above. However, while this method can shorten the period of construction, the necessity of working day and night for a short period of time requires working in two or three shifts, and therefore requires many workers and engineers at one time, involving the difficulty of obtaining an adequate working force. In addition to this disadvantage in work control, according to this method, since concrete is directly poured in the field, the quality of the silo cylinder depends upon such natural conditions as weather at the time of pouring, and especially in the rainy or dry season, the quality is greatly affected. Furthermore, the quality control of the concrete itself is very difficult, causing indefinite factors in the quality such as airtightness and strength, which are important for the silo cylinder, which is a further large disadvantage of this method.

SUMMARY OF THE INVENTION

According to the present invention, silo cylinders are constructed by using precast concrete members, as unit members, the forming of which can be controlled exactly and properly under all conditions so as to control the quality of concrete by controlling such aspects as mixing of the concrete, arrangement of reinforcing bars, way of pouring and curing, and which members therefore have high dimensional accuracy and uniform quality. For this reason, the quality of the silo cylinders it not affected by such natural conditions as weather during construction and many workers are not required at one time for execution of the construction, enabling the construction to be executed at a constant work volume and constant work force, and facilitating the control. Particularly, the present invention uses precast concrete members as unit component members to construct silo cylinders arranged lengthwise and crosswise in a silo complex with said silo cylinders as main silo means and the spaces formed among the respectively adjacent silo cylinders as sub silo means. In this case the lengthwise, crosswise and vertical joining of said unit members is made very reasonably, and such lengthwise, crosswise and vertical reasonable structure is given prestress to substantially solidify the lengthwise and crosswise arranged silo cylinders. In other words, these silo cylinders have a very high strength in the silo complex with structural and dynamic solidification greater than the silo cylinders obtained by solid concrete pouring by a method such as said sliding form method. The present invention is described below in detail based on examples.

BRIEF DESCRIPTION OF THE DRAWINGS

Figure 2:
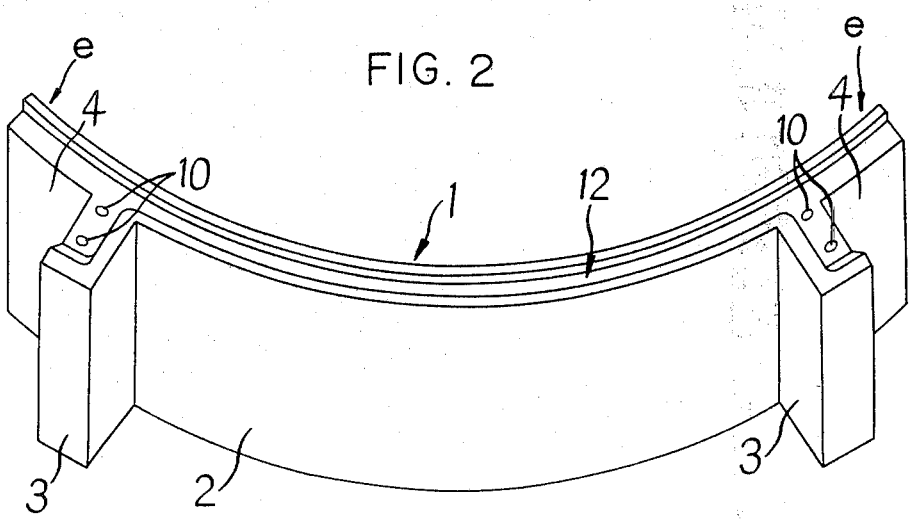
FIG. 2 is a fragmentary, vertical cross-sectional view of the partition wireway, taken along the line II—II, FIG. 1.
Figure 3:
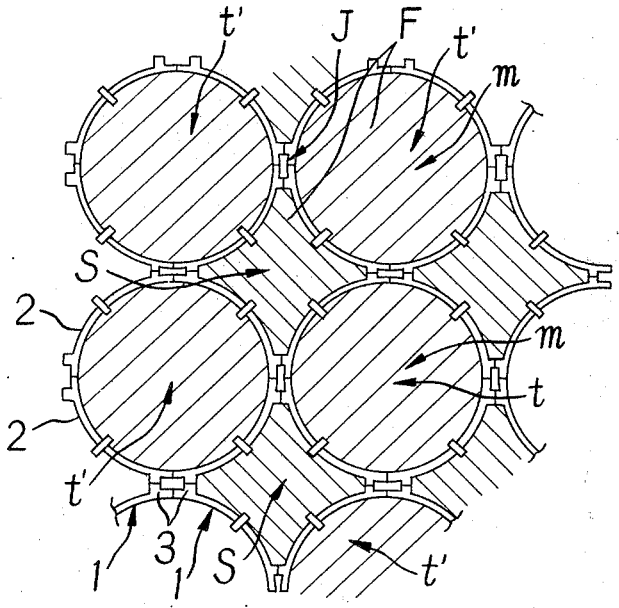
FIG. 3 is a fragmentary, vertical cross-sectional view of the partition wireway, taken along the line III—III, FIG. 1.
Figure 4:
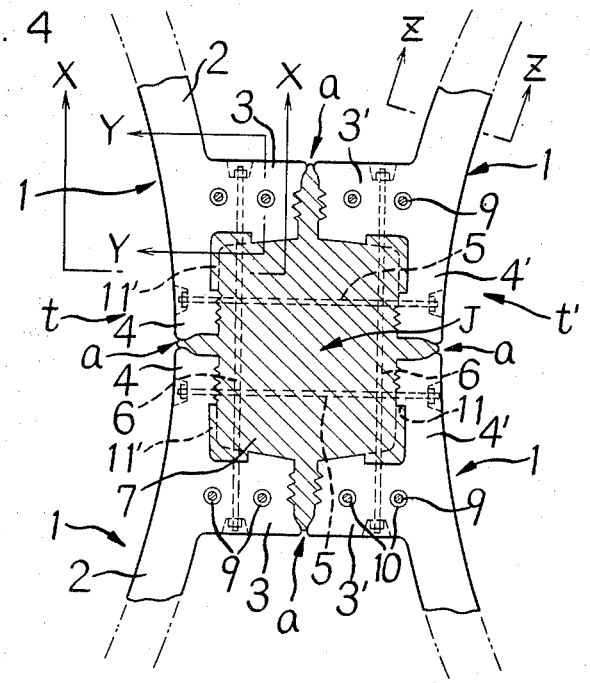
FIG. 4 is a fragmentary, side elevational view of the partition wireway with a portion thereof broken away to reveal internal construction.
Figure 5:
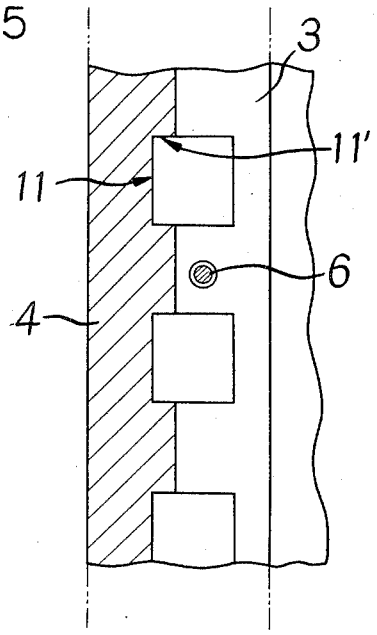
Figure 6:
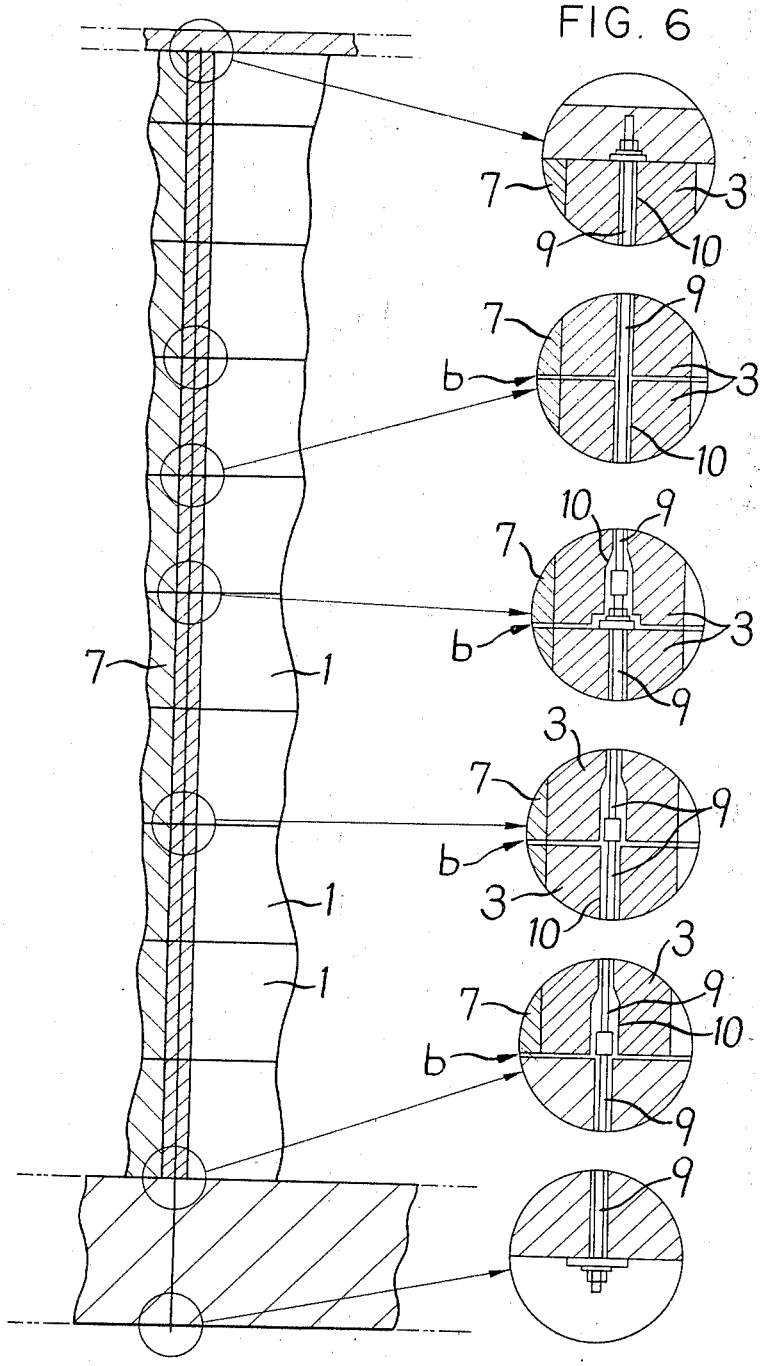
Figure 7:
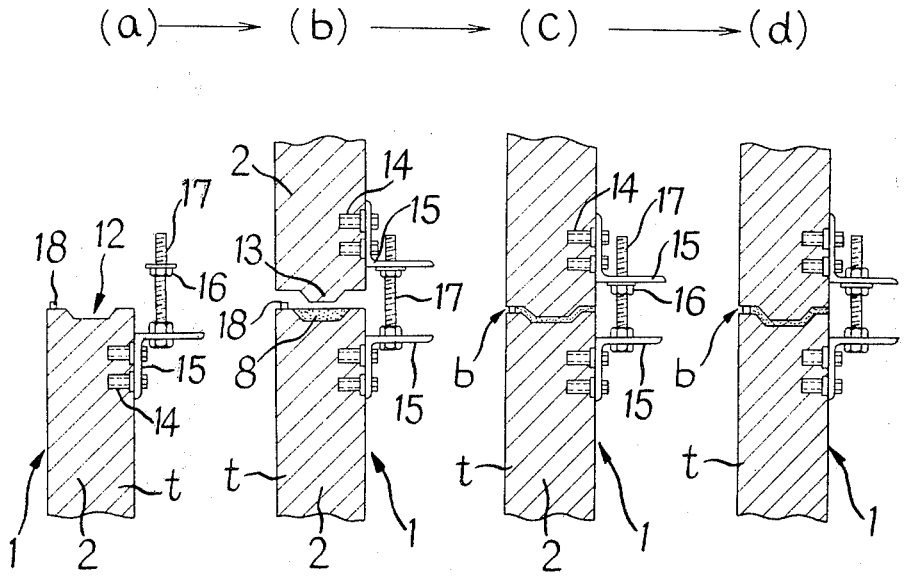
Figure 8:
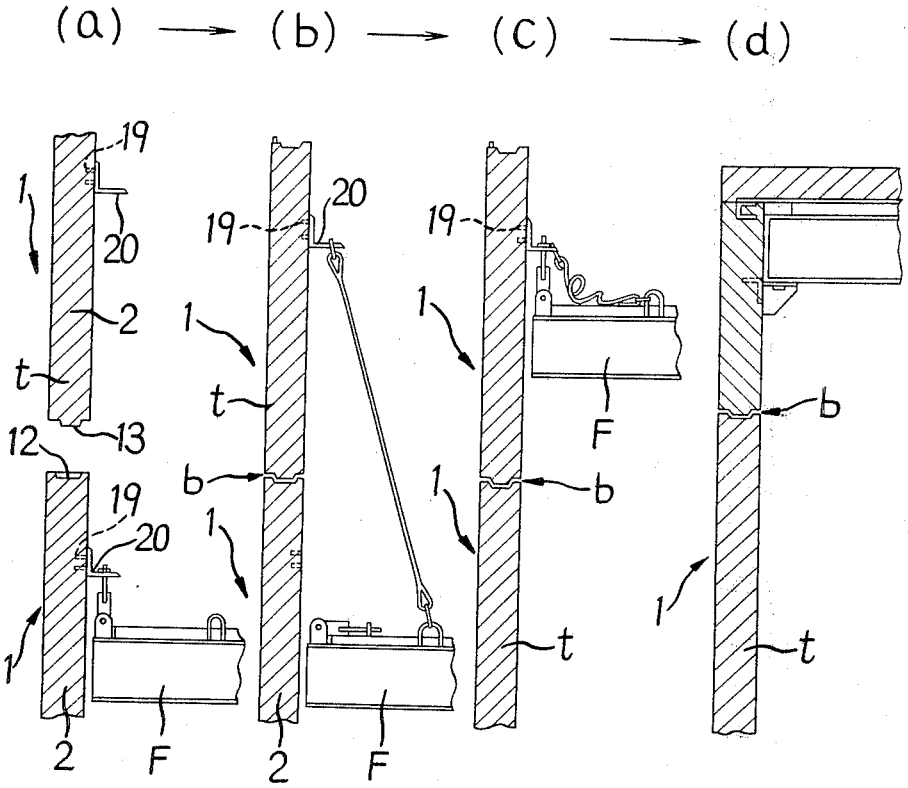
Figure 9:
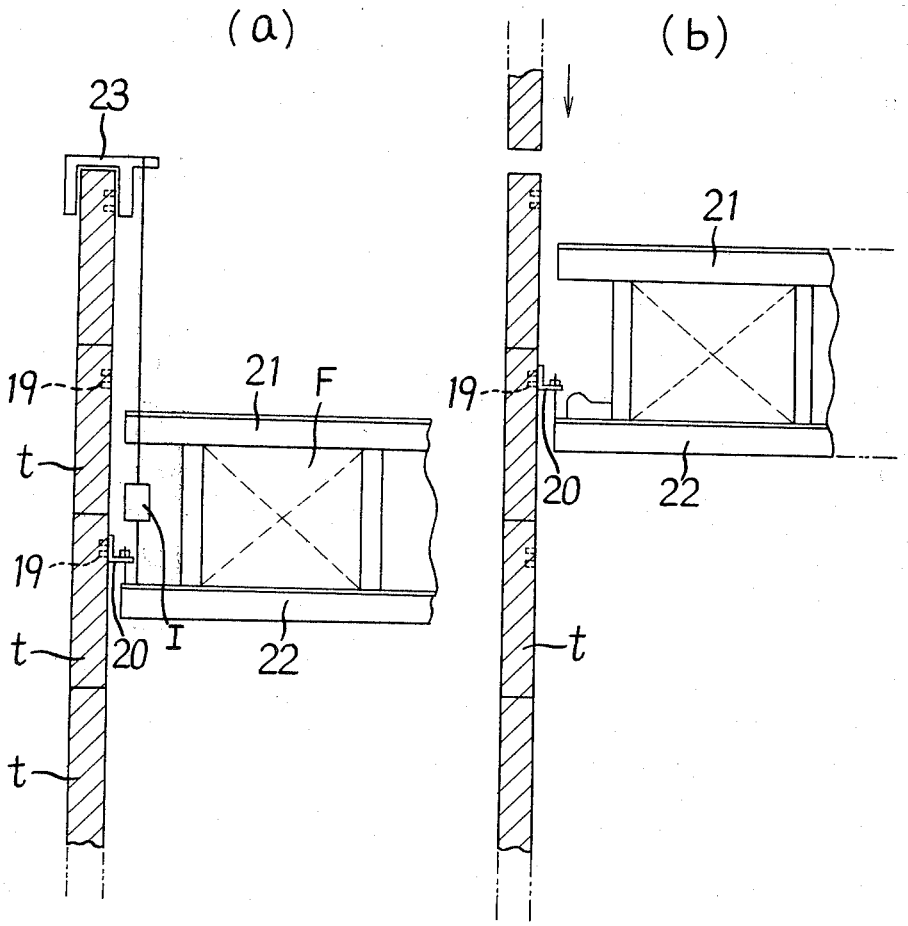

FIG. 1 is a partial perspective general view of the silo complex according to the present invention;

FIG. 2 is an enlarged perspective view of one of the unit members thereof;

FIG. 3 is a partial plan view for illustrating the process of construction of the silo complex;

FIG. 4 is an enlarged plan view of a connection among four unit members assembled as in FIG. 3;

FIG. 5 is a sectional view on line X—X of FIG. 4;

FIG. 6 is a sectional view on line Y—Y of FIG. 4 in an erected silo cylinder, with the portions in the circles illustrated on an enlarged scale;

FIGS. 7 (*a*)-(*d*) are sectional views on line Z—Z of FIG. 4 showing successive steps in joining the horizontal joints;

FIGS. 8 (*a*)-(*d*) are sectional views of successive steps in moving scaffolding frames; and FIGS. 9 (*a*) and (*b*) are sectional view of steps in moving scaffolding frames.

DETAILED DESCRIPTION OF THE INVENTION

The basic unit member 1 of the silo complex of the present invention is a quarter-cylindrical precast concrete member 2 as shown in FIG. 2, provided with a pair of radially protruding couplings 3 as high as the member 2 and located near the ends e of the member 2. Said unit members 1 are assembled horizontally and vertically to form a unit cylinder t, and said unit cylinder t and adjacent unit cylinders t' are arranged lengthwise and crosswise in the silo complex as shown in FIG. 1, with the couplings 3 opposed to couplings 3' on the adjacent unit cylinders t', thereby forming a coupling space J between each two adjacent unit cylinders t and t' surrounded by the opposed two pairs of couplings 3 and 3' and by the end portions 4 and 4' between said couplings 3 and 3' and the respective ends of the members 2. Horizontal clamp rods 5 are mounted across said coupling spaces J between opposite end portions 4 and 4' and rods 6 are mounted across said spaces J between said couplings 3 and 3' on adjacent unit members 1, as shown in FIG. 4, and conrete 7 is placed in said coupling spaces. Spaces a are left between the opposed couplings 3 and 3' and the end portions 4 and 4'. Horizontal rods 5 and 6 are then tensioned to connect adjacent unit cylinders t and t', solidifying the lengthwise and crosswise arranged unit cylinders t and t', . . . Such tensioning of the horizontal rods 5 and 6 prestresses said concrete 7 and is done when the concrete reaches a predetermined strength after pouring. Said unit members 1 are joined vertically by mortar as said unit members are placed on top of each other to form the cylinders, and vertical clamp rods 9 are passed vertically through holes 10 in said unit members and tensioned to solidify the unit cylinders t vertically. The through holes 10 for the vertical clamp rods 9 are formed beforehand in said unit members 1. The tensioning of said vertical clamp rods 9 to give prestress to said unit members 1 is carried out each time several stages (ex. 5 stages) of said unit members 1 are assembled vertically to secure vertical solidification of unit cylinders t at each predetermined height. Therefore, even if an external force is applied during construction as described later, the damage to the joints can be prevented. In the present invention, silo cylinders T with a desired height are solidified lengthwise and crosswise, with the inside of said silo cylinders T as main silo spaces m and the spaces formed among the adjacent silo cylinders T,T', . . . as sub silo spaces S.

In general, the silo cylinder T receives two forces, viz. an internal pressure due to the contents such as grain and an external force due to an earthquake, wind, etc. The internal pressure due to the contents such as grain acts as a horizontal and circumferential tensile force at right angles to the silo cylinder T. In the present invention, since the couplings 3 are mutually clamped by the horizontal clamp rods 6 as mentioned before, the respective transverse joints a of the four unit members 1 constituting the unit cylinder t can transmit such tensile force favorably, and therefore have very large resistance against the internal pressure due to the contents. As shown in FIGS. 4 and 5 if horizontal recesses 11 are formed in the end portions and couplings and open into said coupling space J, such recesses 11 and the concrete 7 filling them from space J can, in combination, transmit said tensile force more favorably. The external force due to an earthquake, wind, etc, acts as horizontal force on the silo cylinder T. Such horizontal force acts on the silo cylinder T as bending moment and on the longitudinal joints b between unit cylinders t as a horizontal shearing force. The bending moment on the silo cylinder T causes tensile force on one side and compressive force on the other in the silo cylinder T, but generally, concrete walls are weak in resistance to such tensile force and are liable to crack and to have low airtightness. In the present invention, since the adjacent silo cylinders T and T' are solidly combined by the reinforced concrete 7 in said coupling space J and the horizontal clamp rods 5 clamping said marginal members proper 4 and 4' through said coupling space J as mentioned before, the vertical shearing force caused by the external force in said longitudinal joints b can be favorably transmitted to the respective adjacent silo cylinders T and T'. Since the lengthwise and crosswise arranged silo cylinders T,T', . . . are substantially solidified, the whole moves as a unit in response to the external force, and therefore has large rigidity, small deformation and very large resistance against the external force. In this case, if vertical recesses 11' are formed in the end portions 4 and 4' and couplings 3 and 3' and open into said coupling space J, such recesses 11' and the concrete 7 filling them from space J can, in combination, transmit the vertical shearing force more favorably, thus improving said effect remarkably together with said horizontal clamp rods 5 and 6. Furthermore, in the present invention, since the unit cylinders t formed by joining the unit members 1 and then assembled vertically and sequentially and joined by the mortar 8 are clamped by the vertical clamp rods to provide prestress as mentioned before, the horizontal shearing force at said longitudinal joints b, too, is favorably transmitted, and the resistance to such shearing force is very large. In this case, if a groove 12 is formed along the top of said unit member 1 and a mating protrusion 13 is formed at the bottom so that an upper one will be engaged with a lower one with the mortar 8 therebetween for joining, as shown in FIG. 7, then the horizontal shearing force can be transmitted more favorably.

In the present invention, as described above, the coupling spaces J are formed between the adjacent unit cylinders t and t' by said end portions 4 and 4' and the couplings 3 and 3' and such adjacent unit cylinders t and t' are joined solidly by the reinforced concrete 7 in said coupling spaces J having the horizontal clamp rods 5 and 6 therein, while the unit cylinders t and t' are sequentially stacked, and the stacked unit cylinders t, . . . themselves are solidified by clamping by the vertical clamp rods 9. Therefore, as an important feature, they are substantially more solidified than the silo cylinders constructed monolithically by the sliding form method from the standpoint of dynamics and structure, and have very large strength as mentioned before.

The present invention can further have the means as shown in FIGS. *7a–7d*. The groove 12 is formed in the top of said unit member 2 and the protrusion 13 corresponding to said groove 12 is formed on the bottom. Furthermore, inserts 14 for holding adjusting supports are provided at a plurality of positions on the upper and lower portions of said member 2. When a unit member 1 of the next higher stage is placed on a unit member 1 already connected in a unit cylinder t, the adjusting supports 15 are mounted on the unit member 1 by bolts threaded into the upper inserts 14 of the already connected unit member 1 and mounted on the next higher unit member 1 by bolts threaded into the lower inserts 14 of the next higher unit member 1, and a bolt 17 with an adjusting nut 16 thereon is vertically mounted on each of the adjusting supports 15 mounted on the upper inserts 14, as shown in FIG. *7a*. Each of said adjusting supports 15 on the next higher unit member 1 is supported by the adjusting nut 16 positioned on the upper portion of said bolt 17, to temporarily support the next higher unit member 1 at a position higher than the final joining position, as shown in FIG. *7b*, and to adjust the horizontal position thereof. Then, mortar 8 is placed in said groove 12 of said already connected unit member 1, and the adjusting nuts 16 are lowered, to cause the protrusion 13 on the bottom of said next higher unit member 1 engage in the groove 12 of said already connected unit member 1 with the mortar 8 therebetween for joining the unit members. This provides means for making it possible that even silo cylinders T which are difficult to erect and repair can be constructed with very high accuracy, since slabs, etc, are not used intermediately, unlike precast concrete buildings in general. A gasket 18 can be mounted on one of the opposed faces of the members 2 outside said groove 12, and the gasket 18 serves both as a mold to prevent leakage of the mortar 8 outside the unit cylinder 1 and also as an airtightness means after joining of the unit members.

The present invention can also have means for suspending and supporting scaffold means as shown in FIGS. *8a–8d*. Inserts 19 for mounting suspending supports are provided at the upper portion of each unit member 2, and scaffolding frames F are suspended and supported in the spaces in the unit cylinders t, viz. main silo space m and in the spaces formed among the adjacent units, viz. sub silo spaces S by suspending supports 20 mounted on the inserts 19. In this arrangements, said scaffolding frames F are suspended from and supported by the supports 20 on the already connected unit cylinders 1, while the next higher unit cylinders 1 are joined, as shown in FIG. *8a*, and then supports 20 are mounted on the next higher unit cylinders 1 and cables connected